US011024493B2

(12) United States Patent
Yamamoto et al.

(10) Patent No.: US 11,024,493 B2
(45) Date of Patent: Jun. 1, 2021

(54) ANALYZING DEVICE, ANALYTICAL DEVICE, ANALYZING METHOD, AND COMPUTER PROGRAM PRODUCT

(71) Applicant: SHIMADZU CORPORATION, Kyoto (JP)

(72) Inventors: Takushi Yamamoto, Kyoto (JP); Eiichi Matsuo, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/576,902

(22) Filed: Sep. 20, 2019

(65) Prior Publication Data

US 2020/0098553 A1 Mar. 26, 2020

(30) Foreign Application Priority Data

Sep. 21, 2018 (JP) ..... JP2018-177900

(51) Int. Cl.
*H01J 49/00* (2006.01)
*H01J 49/16* (2006.01)

(52) U.S. Cl.
CPC ..... *H01J 49/0036* (2013.01); *H01J 49/0004* (2013.01); *H01J 49/161* (2013.01)

(58) Field of Classification Search
CPC ..... H01J 49/0004; H01J 49/0413; G01N 23/225; G01N 27/628
USPC ..... 250/281, 282, 288
See application file for complete search history.

(56) References Cited

U.S. PATENT DOCUMENTS 5,746,829 A * 5/1998 Matsunaga ..... C30B 33/00 117/200
7,872,223 B2 * 1/2011 Yamaguchi ..... H01J 49/0004 250/281
2004/0137491 A1 * 7/2004 Okamoto ..... G01N 23/225 435/6.11
2009/0159789 A1 * 6/2009 Yamaguchi ..... H01J 49/0004 250/281
2011/0315874 A1 * 12/2011 Ikegami ..... H01J 49/0004 250/288
2019/0115200 A1 4/2019 Harada

FOREIGN PATENT DOCUMENTS

WO 2017183086 A1 10/2017

OTHER PUBLICATIONS

Communication dated Feb. 13, 2020 in European Patent Application No. 19198333.7.

* cited by examiner

*Primary Examiner* — David A Vanore
(74) *Attorney, Agent, or Firm* — Sughrue Mion, PLLC

(57) ABSTRACT

An analyzing device includes: a measurement data acquisition unit that acquires measurement data obtained by irradiating a plurality of irradiation positions on a sample with a laser beam and performing mass spectrometry on a sample component corresponding to each irradiation position; and an analysis unit that performs analysis of the measurement data by excluding a set of data corresponding to an excluded irradiation position among the plurality of irradiation positions each having a different irradiation portion from which a portion that has been already irradiated with the laser beam is excluded in an irradiation range irradiated when the laser beam is irradiated to each irradiation position.

16 Claims, 9 Drawing Sheets

FIG. 5

Tb

| RATIO OF DISTANCE OF IRRADIATION POSITIONS TO LASER IRRADIATION DIAMETER | SCANNING ORDER | | THE NUMBER OF ROWS OR COLUMNS TO BE DELETED | | | |
|---|---|---|---|---|---|---|
| | STARTING POINT | DIRECTION | TOP | BOTTOM | LEFT | RIGHT |
| 0.5 | UPPER LEFT | RIGHT | 1 | 0 | 1 | 1 |
| 0.2 | UPPER LEFT | RIGHT | 1 | 0 | 2 | 2 |
| 0.1 | UPPER LEFT | RIGHT | 1 | 0 | 3 | 3 |
| 0.5 | UPPER LEFT | DOWN | 1 | 1 | 1 | 0 |
| 0.2 | UPPER LEFT | DOWN | 2 | 2 | 1 | 0 |
| 0.1 | UPPER LEFT | DOWN | 3 | 3 | 1 | 0 |
| 0.5 | LOWER LEFT | RIGHT | 0 | 1 | 1 | 1 |
| 0.2 | LOWER LEFT | RIGHT | 0 | 1 | 2 | 2 |
| 0.1 | LOWER LEFT | RIGHT | 0 | 1 | 3 | 3 |
| 0.5 | LOWER LEFT | UP | 1 | 1 | 1 | 0 |
| 0.2 | LOWER LEFT | UP | 2 | 2 | 1 | 0 |
| 0.1 | LOWER LEFT | UP | 3 | 3 | 1 | 0 |

ANALYZING DEVICE, ANALYTICAL DEVICE, ANALYZING METHOD, AND COMPUTER PROGRAM PRODUCT

INCORPORATION BY REFERENCE

The disclosure of the following priority application is herein incorporated by reference: Japanese Patent Application No. 2018-177900 filed Sep. 21, 2018

TECHNICAL FIELD

The present invention relates to an analyzing device, an analytical device, an analyzing method, and a computer program product.

BACKGROUND ART

Mass spectrometric imaging is a method of performing mass spectrometry on components at a plurality of positions on a sample to acquire a distribution of a molecule having a predetermined mass in the sample. In a case where a tissue section or the like obtained from an organism is used as a sample, it can be observed how a molecule of interest is localized in the organism, so that manifestation and function of the molecule can be analyzed. The mass spectrometric imaging can thus be used for various analyses utilizing positional information on molecules.

In mass spectrometry imaging, matrix-assisted laser desorption ionization (MALDI) is suitably used as a way of ionizing a sample. In this case, a plurality of positions (irradiation positions) in the sample are sequentially irradiated with a laser beam and ionized, so that sample components at each position are sequentially ionized to perform mass separation and detection.

Here, when a portion of the sample having been irradiated with the laser beam is again irradiated with the laser beam, the amount of the sample component extracted and ionized from the portion by the second and subsequent irradiations is significantly reduced compared with that extracted from the portion by the first irradiation. Therefore, in a case where a plurality of irradiation positions are sequentially irradiated with a laser beam, if there is overlap of irradiation ranges corresponding to different irradiation positions, the amount of sample components to be ionized in an overlapping portion of the irradiation ranges are different between the first irradiation and in the second irradiation. This causes variations in the analysis of a distribution of the sample components. PTL1 describes that the cross-section of the laser beam is shaped such that a single shape of the cross-section can tessellate a plane, as a result of which overlap of the irradiation ranges is reduced.

CITATION LIST

Patent Literature

PTL1: WO2017/183086

SUMMARY OF INVENTION

Technical Problem

In mass spectrometry in which a plurality of positions on a sample are irradiated with a laser beam, a problem arises in that the accuracy in the analysis is lowered due to an overlap between irradiation ranges.

Solution to Problem

According to a first aspect of the present invention, an analyzing device comprises: a measurement data acquisition unit that acquires measurement data obtained by irradiating a plurality of irradiation positions on a sample with a laser beam and performing mass spectrometry on a sample component corresponding to each irradiation position; and an analysis unit that performs analysis of the measurement data by excluding a set of data corresponding to an excluded irradiation position among the plurality of irradiation positions each having a different irradiation portion from which a portion that has been already irradiated with the laser beam is excluded in an irradiation range irradiated when the laser beam is irradiated to each irradiation position.

According to a second aspect of the present invention, in the analyzing device according to the first aspect, it is preferable that the excluded irradiation position is determined based on a value of an area of the irradiation portion.

According to a third aspect of the present invention, in the analyzing device according to the second aspect, it is preferable that the area is calculated based on an irradiation diameter of the laser beam and a distance between the plurality of irradiation positions.

According to a fourth aspect of the present invention, in the analyzing device according to any one of the first to third aspects, it is preferable that the analysis unit creates data corresponding to an intensity image in which intensities of a molecule corresponding to a predetermined m/z are correlated with a plurality of pixels corresponding to a plurality of respective positions of the sample; and the plurality of pixels include no pixel corresponding to the excluded irradiation position.

According to a fifth aspect of the present invention, in the analyzing device according to the fourth aspect, it is preferable that the analysis unit excludes a set of data corresponding to a predetermined number of rows or columns from an end of the intensity image in the measurement data or in data based on the measurement data, when creating data corresponding to the intensity image.

According to a sixth aspect of the present invention, in the analyzing device according to the fifth aspect, it is preferable that the analysis unit excludes a set of data corresponding to first and second numbers of rows from upper and lower ends of the intensity image, respectively, in the measurement data or the data based on the measurement data, and excludes a set of data corresponding to third and fourth numbers of columns from left and right ends of the intensity image, respectively, wherein at least one of the first, second, third, and fourth numbers is different from other numbers.

According to a seventh aspect of the present invention, in the analyzing device according to the sixth aspect, it is preferable that when the plurality of irradiation positions corresponding to respective rows in the intensity image are sequentially scanned by the laser beam, the analysis unit excludes a first row from one of the upper and lower ends of the intensity image and at least one column from the left and right ends of the intensity image; and when the plurality of irradiation positions corresponding to respective columns in the intensity image are sequentially scanned by the laser beam, the analysis unit excludes a first column from one of the left and right ends of the intensity image and at least one row from the upper and lower ends of the intensity image.

According to an eighth aspect of the present invention, in the analyzing device according to any one of the fourth to seventh aspects may further comprise: a display unit that displays the intensity image.

According to a ninth aspect of the present invention, an analytical device comprises: the analyzing device according to any one of the first to eighth aspects; and a mass spectrometer that performs mass spectrometry.

According to a tenth aspect of the present invention, an analyzing method comprises: acquiring measurement data obtained by irradiating a plurality of irradiation positions on a sample with a laser beam and performing mass spectrometry on a sample component corresponding to each irradiation position; and analyzing the measurement data by excluding a set of data corresponding to an excluded irradiation position among the plurality of irradiation positions each having a different irradiation portion from which a portion that has been already irradiated with the laser beam is excluded in an irradiation range irradiated when the laser beam is irradiated to each irradiation position.

According to an eleventh aspect of the present invention, a computer readable computer program product having a program that causes a processor to perform: a measurement data acquisition process of acquiring measurement data obtained by irradiating a plurality of irradiation positions on a sample with a laser beam and performing mass spectrometry on a sample component corresponding to each irradiation position; and an analysis process of performing analysis of the measurement data by excluding a set of data corresponding to an excluded irradiation position among the plurality of irradiation positions each having a different irradiation portion from which a portion that has been already irradiated with the laser beam is excluded in an irradiation range irradiated when the laser beam is irradiated to each irradiation position.

Advantageous Effects of Invention

According to the present invention, shaping the cross-sectional shape of the laser beam is not always necessary, and still it is possible to reduce a decrease in accuracy in the analysis due to an overlap of irradiation ranges corresponding to the respective irradiation positions.

BRIEF DESCRIPTION OF DRAWINGS

FIG. 5 is a table showing reference data.

DESCRIPTION OF EMBODIMENTS

Hereinafter, an embodiment of the present invention will be described with reference to the drawings. An analytical device according to the following embodiment is a mass spectrometry device (imaging mass spectrometry device) that can be used for mass spectrometric imaging.

First Embodiment

Figure 1:
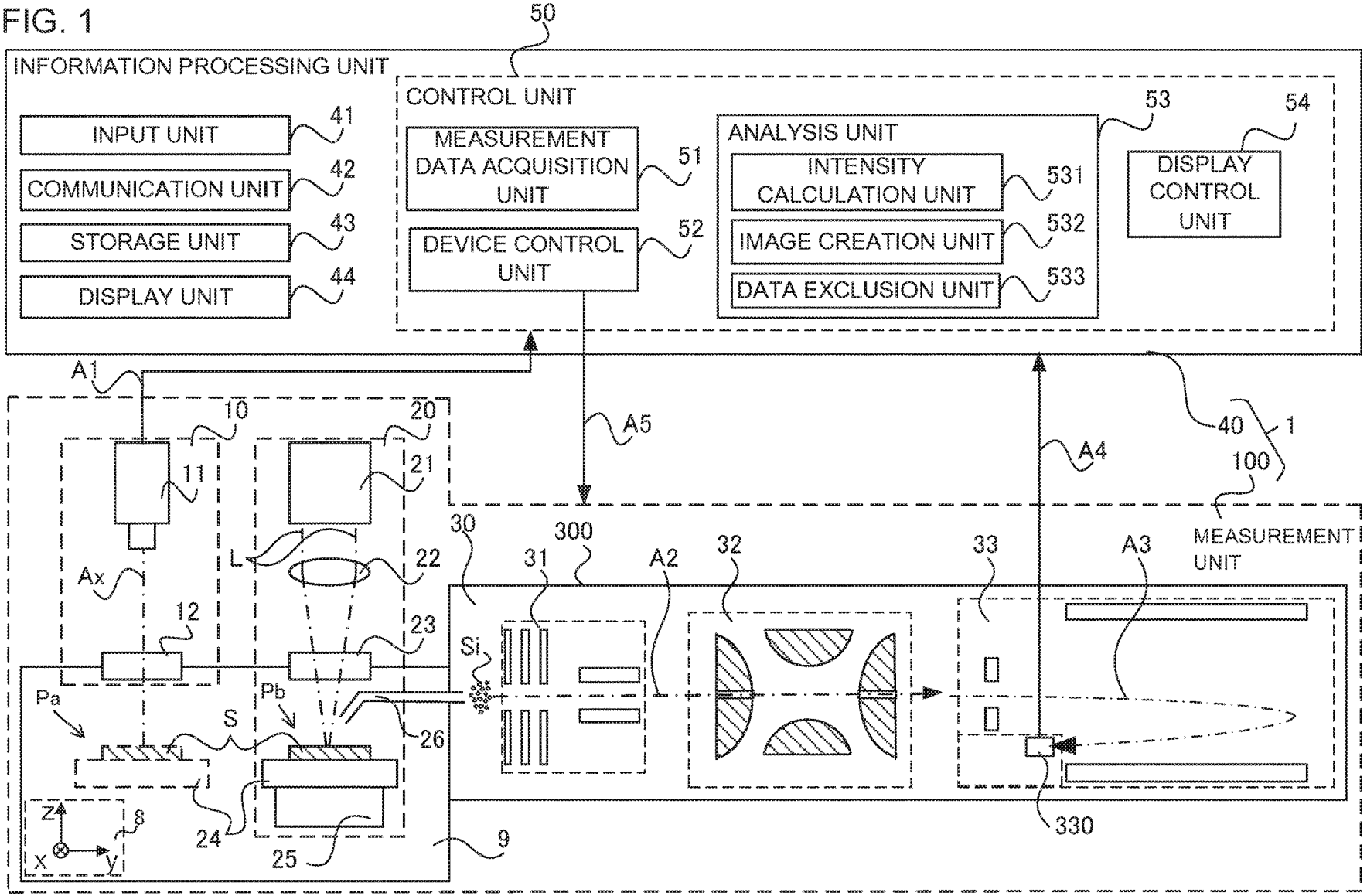
FIG. 1 is a conceptual view showing a configuration of an analytical device according to one embodiment.

FIG. 1 is a conceptual view for explaining an analytical device according to the present embodiment. The analytical device 1 includes a measurement unit 100 and an information processing unit 40. The measurement unit 100 includes a sample chamber 9, a sample image capturing unit 10, an ionization unit 20, and a mass spectrometry unit 30.

The sample image capturing unit 10 includes an image-capturing unit 11 and an observation window 12. The ionization unit 20 includes a laser irradiation unit 21, a condensing optical system 22, an irradiation window 23, a sample stage 24 on which a sample S is to be placed, a sample stage drive unit 25, and an ion transport tube 26. The mass spectrometry unit 30 includes a vacuum chamber 300, an ion transport optical system 31, a first mass separation unit 32, and a second mass separation unit 33. The second mass separation unit 33 includes a detection unit 330.

The information processing unit 40 includes an input unit 41, a communication unit 42, a storage unit 43, a display unit 44, and a control unit 50. The control unit 50 includes a measurement data acquisition unit 51, a device control unit 52, an analysis unit 53, and a display control unit 54. The analysis unit 53 includes an intensity calculation unit 531, an image creation unit 532, and a data exclusion unit 533.

The sample chamber 9 is a chamber in which substantially atmospheric pressure is maintained. In the sample chamber 9, the sample stage 24 and the sample stage drive unit 25 provided with a motor, a speed reduction mechanism, and the like are disposed. The sample stage 24 can be moved by the sample stage drive unit 25 between an image-capturing position Pa at which the image-capturing unit 11 can capture an image of the sample S, and an ionization position Pb at which the sample S can be irradiated with a laser beam L. The sample chamber 9 is provided with the observation window 12 and the irradiation window 23. A surface of the sample stage 24 on which the sample S is to be placed is arranged in the xy plane, and an optical axis Ax of the sample image capturing unit 10 is defined along the z-axis (see coordinate axes 8). The y-axis is parallel to an ion optical axis of the mass spectrometry unit 30, and the x-axis is perpendicular to the y-axis and the z-axis.

The sample image capturing unit 10 captures an image of the sample S (hereinafter referred to as a sample image) at the image-capturing position Pa. The sample image capturing unit 10 outputs a signal obtained through photoelectric conversion of light from the sample S, to the control unit 50 (an arrow A1).

The sample image is not particularly limited as long as it is an image showing a plurality of positions in a portion to be analyzed in the sample S, correlated with intensity or wavelength of light from the positions. For example, the sample image is an image of light transmitted through the sample S irradiated with light from a transmission illumination unit (not shown), captured by the image-capturing unit 11. In capturing a sample image, a specific structure or molecule of the sample S may be stained with a staining reagent or labeled with a fluorescent substance introduced by antibody reaction or genetic recombination, for example. The image-capturing unit 11 can then output a signal obtained through photoelectric conversion of light from the stained portion or from the fluorescent substance or the like, to the control unit 50.

The image-capturing unit 11 includes an image sensor such as a CCD or a CMOS. Light from the sample S placed on the sample stage 24 transmits through the observation window 12 and enters the image-capturing unit 11. The image-capturing unit 11 photoelectrically converts the light from the sample S with a photoelectric conversion element for each pixel of the image sensor. The image-capturing unit 11 performs an A/D conversion on a signal obtained through photoelectric conversion and generates sample image data in which a position in a sample image corresponding to each pixel is correlated with a pixel value obtained by the A/D conversion. The image-capturing unit 11 then outputs the sample image data to the control unit 50.

The ionization unit 20 irradiates a plurality of positions in a portion to be analyzed in the sample S at the ionization position Pb with the laser beam L to ionize the sample S. The position in the sample S irradiated with the laser beam L for ionization is referred to as an irradiation position. The ionization unit 20 sequentially irradiates irradiation positions with the laser beam L to sequentially ionize sample components in an irradiation range corresponding to each irradiation position.

The laser irradiation unit 21 includes a laser light source. The type of the laser light source is not particularly limited as long as each irradiation position of the sample S can be irradiated with the laser beam L having a desired irradiation diameter to cause ionization of sample components. For example, the laser light source may be a device that emits, through oscillation, the laser beam L having a wavelength corresponding to the ultraviolet to infrared region. Here, the irradiation diameter refers to the maximum diameter of a portion on the surface of the sample irradiated with the laser beam.

The condensing optical system 22 includes a lens and the like to adjust an irradiation range of the laser beam L in the sample S. The laser beam L having passed through the condensing optical system 22 transmits through the irradiation window 23 and enters the sample S. In the following, for the sake of clarity, the shape of a cross section of the laser beam L perpendicular to its traveling direction is a circle, and the laser beam L enters from a direction perpendicular to the surface of the sample S (generally parallel to the xy plane). In this case, an irradiation range in the sample S has a circular shape having a diameter equal to the irradiation diameter. The irradiation diameter is, for example, several hundreds nm to several tens μm depending on the wavelength of the laser beam L.

When the laser beam L is irradiated onto an irradiation position of the sample S, sample components in an irradiation range are desorbed and ionized to generate sample-derived ions Si. In the following, the sample-derived ions Si refer to not only ionized samples S, but also ions generated by dissociation or decomposition of the ionized samples S, ions obtained by attachment of atoms or atomic groups to the ionized samples S, and the like. The sample-derived ions Si released from the sample S pass through the inside of the ion transport tube 26 and are introduced into the vacuum chamber 300 of the mass spectrometry unit 30.

The sample stage 24 can move at least in the x direction and the y direction by the sample stage drive unit 25. After an irradiation position in the sample S is irradiated with the laser beam L, the sample stage 24 moves so that the next irradiation position is irradiated with the laser beam L. In this way, the laser beam L scans over the sample S by relative movement of the sample stage 24 with respect to an optical path of the laser beam L. Thus, the term "ionization position Pb" includes a plurality of positions of the sample S at which the laser beam L is irradiated with each irradiation position.

Note that the irradiation position may be changed by changing the optical path of the laser beam L, instead of moving the sample stage 24.

The mass spectrometry unit 30 performs detection through mass separation of the sample-derived ions Si. Paths of the sample-derived ions Si (an ion optical axis A2 and an ion flight path A3) in the mass spectrometry unit 30 are schematically indicated by dashed-and-dotted arrows. The sample-derived ions Si introduced into the vacuum chamber 300 enter the ion transport optical system 31.

The ion transport optical system 31 includes elements that control movement of ions, such as an electrostatic electromagnetic lens and a high-frequency ion guide, to transport the sample-derived ions Si to the first mass separation unit 32 while converging a trajectory of the sample-derived ions Si. The vacuum chamber 300 is divided into a plurality of vacuum compartments having different degrees of vacuum. Elements of the ion transport optical system 31 are respectively arranged in a plurality of vacuum compartments. A vacuum compartment located closer to the first mass separation unit 32 has a higher degree of vacuum, with the degree of vacuum increasing stepwise as appropriate. Each vacuum compartment is evacuated by a vacuum pump (not shown).

The first mass separation unit 32 includes a mass analyzer, such as an ion trap, and performs dissociation and mass separation of the sample-derived ions Si. In a case where the first mass separation unit 32 includes an ion trap as in the example of FIG. 1, mass separation and the like in two or more stages can be performed as appropriate. The first mass separation unit 32 and the second mass separation unit 33 described later are evacuated by a vacuum pump, such as a turbo molecular pump, to a degree of vacuum depending on the disposed mass analyzer. The sample-derived ions Si that have passed through the first mass separation unit 32 or obtained by dissociation or mass separation in the first mass separation unit 32 are introduced into the second mass separation unit 33.

The second mass separation unit 33 includes a mass analyzer such as a time-of-flight mass analyzer to perform mass separation of the sample-derived ions Si. In the example of FIG. 1 wherein the second mass separation unit 33 is a time-of-flight mass analyzer, a flight path A3 of the sample-derived ion Si is schematically indicated by a dashed-and-dotted arrow.

The detection unit 330 includes an ion detector such as a microchannel plate to detect the sample-derived ions Si having entered thereto. The detection mode may be either a positive ion mode for detecting positive ions or a negative ion mode for detecting negative ions. A detection signal obtained by detecting the ion is A/D-converted into a digital signal. The digital signal is input to the information processing unit 40 (an arrow A4) and then stored in the storage unit 43 as measurement data.

The information processing unit 40 includes an information processor such as an electronic computer, so that the information processing unit 40 serves as an interface with a user of the analytical device 1 (hereinafter simply referred to as a "user") as appropriate and further performs processing such as communication, storage, and computation of various data. The information processing unit 40 serves as a processor that performs processing, such as control of the measurement unit 100, analysis, and display.

Note that the information processing unit 40 may be integrated with the measurement unit 100 into one single device. Further, a part of data used by the analytical device 1 may be stored in a remote server or the like, and a part of arithmetic processing to be performed by the analytical device 1 may be performed by the remote server or the like. The control of the operation of each component of the measurement unit 100 may be performed by the information processing unit 40 or may be performed by a device constituting each component.

The input unit 41 of the information processing unit 40 includes an input device such as a mouse, a keyboard, various types of buttons, and/or a touch panel. The input unit 41 receives information required for measurement performed by the measurement unit 100 and processing performed by the control unit 50, for example, from the user.

The communication unit 42 of the information processing unit 40 includes a communication device that can communicate via a network such as the Internet with wireless or wired connection. The communication unit 42 transmits and receives necessary data as appropriate. For example, the communication unit 42 receives data necessary for the measurement by the measurement unit 100 and transmits data processed by the control unit 50.

The storage unit 43 of the information processing unit 40 includes a non-volatile storage medium. The storage unit 43 stores reference data (described later), measurement data based on a detection signal output from the detection unit 330, and a program for executing processing by the control unit 50, and the like.

The display unit 44 of the information processing unit 40 includes a display device such as a liquid crystal monitor. The display unit 44 is controlled by the display control unit 54 to display information on analytical conditions of the measurement by the measurement unit 100, data obtained by the analysis by the analysis unit 53, and the like, on the display device.

The control unit 50 of the information processing unit 40 includes a processor such as a CPU. The control unit 50 performs various types of processing by executing programs stored in the storage unit 43 or the like, such as control of the measurement unit 100 and analysis of measurement data.

The measurement data acquisition unit 51 acquires measurement data stored in the storage unit 43 and stores the acquired measurement data in a storage device such as a memory of a processor.

The device control unit 52 controls the operation of each component of the measurement unit 100. The device control unit 52 acquires an irradiation position, an order in which irradiation positions are irradiated (hereinafter referred to as an irradiation order), and the irradiation diameter, which are set by an input from the input unit 41. The device control unit 52 controls the laser irradiation unit 21, the condensing optical system 22, and the sample stage 24 to cause the sample S to be irradiated with the laser beam L according to the set irradiation order, irradiation position, and irradiation diameter.

The analysis unit 53 performs analysis of measurement data, including creation of an intensity image (described later).

The intensity calculation unit 531 of the analysis unit 53 correlates m/z of a detected sample-derived ion Si with the detected intensity, based on the measurement data acquired by the measurement data acquisition unit 51, to calculate the detected intensity corresponding to the sample-derived ion Si.

In a case where the second mass separation unit 33 performs time-of-flight mass separation, the intensity calculation unit 531 converts a flight time into m/z using calibration data acquired in advance, and creates data corresponding to a mass spectrum in which m/z and the detected ion intensity are correlated with each other. From the m/z value for detecting a molecule to be analyzed (hereinafter referred to as a target molecule) set by the input from the input unit 41 or the like, the intensity calculation unit 531 identifies a peak of the mass spectrum corresponding to the target molecule or its fragment ion. After performing noise reduction processing such as background removal, the intensity calculation unit 531 calculates a peak intensity or a peak area of the identified peak as a value indicating a magnitude of the detected intensity of the target molecule. One or more target molecules may be used.

The intensity calculation unit 531 causes the storage unit 43 to store intensity data in which each irradiation position and the intensity of the target molecule obtained by irradiating the irradiation position with the laser beam L are correlated with each other. For example, assuming that there are a total of 10,000 irradiation positions (100 vertical positions×100 horizontal positions) arranged in a square lattice, 100 positions arranged in the horizontal direction may correspond to rows of the matrix and 100 positions arranged in the vertical direction may correspond to columns of the matrix. In this case, the intensity calculation unit 531 can cause the storage unit 43 to store, as intensity data, two-dimensional array data corresponding to the 100×100 matrix having the calculated intensities of the target molecule as elements.

Note that the way of expression of the intensity data is not particularly limited as long as the analysis unit 53 can analyze the intensity data.

The image creation unit 532 of the analysis unit 53 creates data corresponding to the intensity image (hereinafter referred to as intensity image data) based on the intensity data. The intensity image is an image showing a plurality of pixels corresponding to a plurality of respective positions of the sample S, correlated with intensities of the target molecule corresponding to a predetermined m/z. The image creation unit 532 assigns each irradiation position to one pixel and converts the intensity of the target molecule corresponding to each irradiation position into a pixel value to create intensity image data, and then stores the created data in the storage unit 43.

The image creation unit 532 can compare intensities of the target molecule at all irradiation positions to acquire the maximum intensity and the minimum intensity of the target molecule. Based on at least one of the maximum intensity and the minimum intensity, the image creation unit 532 can then convert the intensity at each irradiation position into a pixel value. For example, assuming that the maximum intensity of the target molecule is 10000 (A.U.) and the minimum intensity is 100 (A.U.) for all irradiation positions and the intensity is converted into a pixel value of the same color such as red (R) in 256 levels, the intensity value 10000 (A.U.) may be set to a pixel value 255 and the intensity value 100 (A.U.) may be set to 0. An intensity value between the maximum intensity value and the minimum intensity value can be converted so that a change in intensity value and a change in pixel value have a predetermined relationship such as first order.

The data exclusion unit 533 of the analysis unit 53 determines a portion to be excluded in the intensity image data so that the amount of the sample S to be ionized does not become nonuniform. The said portion is a set of intensity image data corresponding to a specific irradiation position, and is determined based on the irradiation diameter of the laser beam L and a distance between the irradiation positions (hereinafter referred to as an irradiation pitch).

Figure 2A:
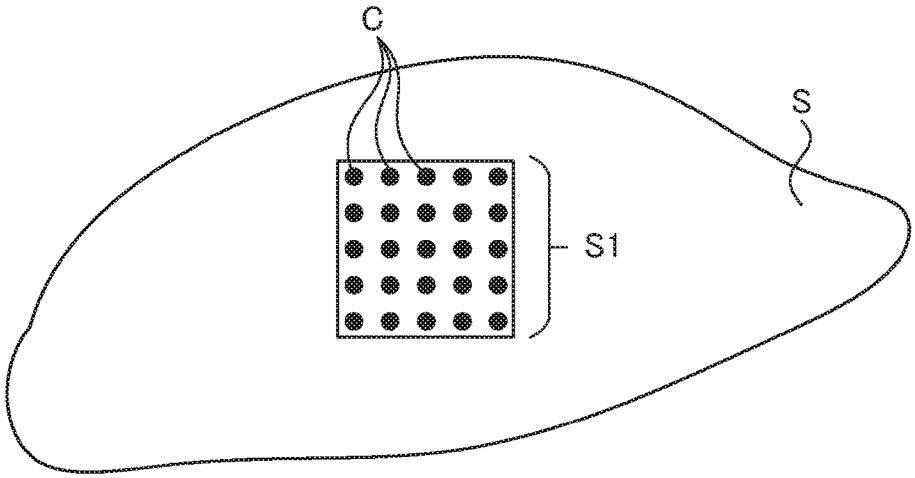
FIG. 2A is a conceptual view for explaining a target region of a sample.

FIG. 2A is a view showing a region to be analyzed in the sample S (hereinafter referred to as a target region S1). In this example, the sample S is assumed to be a tissue section taken from an organism and the target region S1 includes irradiation positions C (5 vertical positions×5 horizontal positions).

Figure 2B:
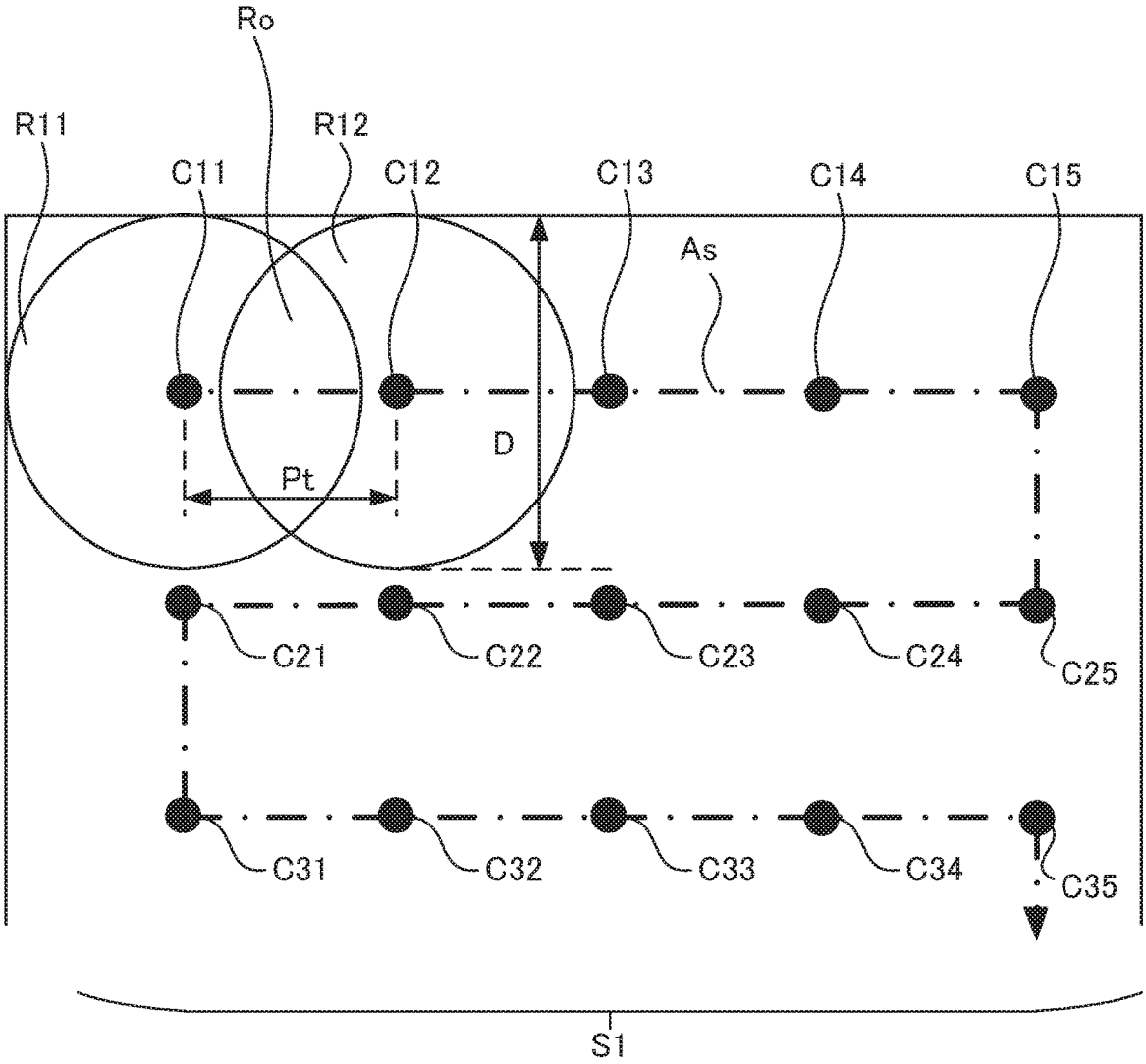
FIG. 2B is a conceptual view for explaining scanning by a laser beam.

FIG. 2B is a conceptual view for explaining scanning by the laser beam L. In the following, "scanning" of the laser beam L means moving the irradiation position C stepwise. In the example of FIG. 2B, an irradiation position C11 at the upper left end in a target region S1 is set as a first irradiation position. The device control unit 52 scans the laser beam L from the irradiation position C11 to the right and irradiates irradiation positions C12, C13, C14, and C15 in this order. Thereafter, turning back at the right end of the target region S1, the laser beam L is scanned to the left to irradiate irradiation positions C25, C24, C23, C22, and C21 in this order. Thereafter, turning back at the left end of the target region S1, the laser beam L is scanned to the right to irradiate irradiation positions C31, C32, C33, C34, and C35 in this order. Such scanning that turns back at both ends in this way is referred to as a reciprocating scanning. The reciprocating scanning is preferable because a relative movement amount of the laser beam L with respect to the sample stage 24 can be reduced so that scanning can be performed quickly. In FIG. 2B, the order of irradiation of irradiation positions is schematically indicated by a dashed-and-dotted arrow As.

Each irradiation position C is irradiated with the laser beam L having an irradiation diameter D. Because the irradiation diameter D is longer than an irradiation pitch Pt, irradiation ranges R11 and R12 of the adjacent irradiation positions C11 and C12, respectively, overlap in an overlap portion Ro. In the overlap portion Ro, the amount of the sample S ionized when the laser beam L is irradiated at a second and subsequent times is significantly reduced compared with the amount of the sample S ionized when the laser beam L is irradiated at the first time. Thus, although areas of the irradiation range R1 and the irradiation range R2 are the same, the amount of the sample S actually ionized at the time of irradiation of the laser beam L is different.

Figure 3A:
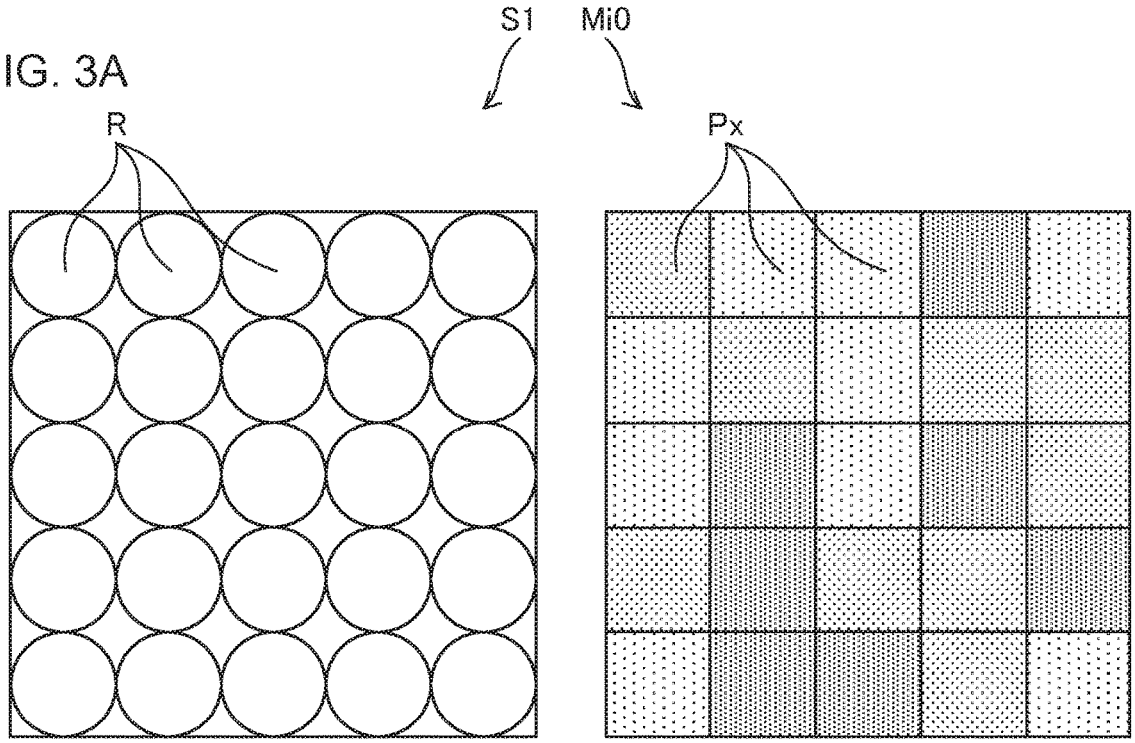
FIG. 3A is a conceptual view for explaining an intensity image in a case where irradiation ranges corresponding to respective irradiation positions do not overlap each other and FIG. 3B is a conceptual view for explaining an intensity image in a case where irradiation ranges corresponding to respective irradiation positions overlap each other.
Figure 3B:
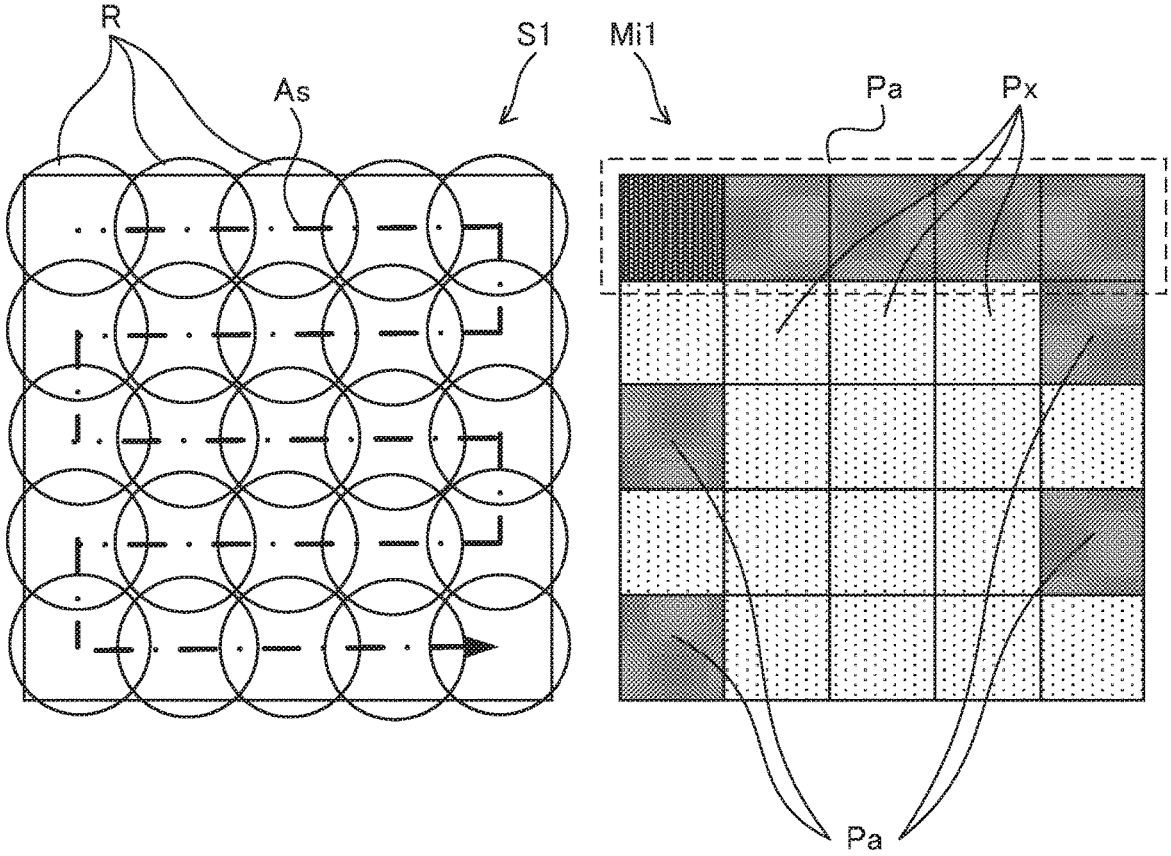

FIG. 3A is a conceptual view for explaining an intensity image Mi0 in a case where irradiation ranges R corresponding to respective irradiation positions do not overlap each other in the target region S1. In FIGS. 3A and 3B, the magnitude of the intensity of the intensity image is indicated by hatching density. It is assumed that there is no pixel having a particularly high intensity (high-intensity pixel as described later), among the pixels Px, in the intensity image Mi0.

FIG. 3B is a conceptual view for explaining an intensity image Mi1 in a case where irradiation ranges R corresponding to respective irradiation positions overlap each other in the target region S1. It is assumed that the laser beam L moves to the right from an irradiation position at the upper left end in the target region S1 as the starting point to perform a reciprocating scanning. In this case, the amount of sample components to be ionized is different due to overlap of irradiation ranges R. Thus, intensity values of nine pixels (hereinafter referred to as high-intensity pixels Pa) are likely measured to be higher than those of other pixels Px. In this way, the presence of an overlap portion of irradiation ranges R corresponding to two different irradiation positions reduces the accuracy of the measurement.

The data exclusion unit 533 excludes a set of intensity image data corresponding to a predetermined number of rows and/or columns from the upper end, the lower end, the left end, or the right end in an intensity image Mi1 acquired under a condition in which the irradiation ranges R overlap each other. Irradiation positions corresponding to a set of intensity image data to be excluded are determined based on an area of the irradiation range R excluding a portion on which the laser beam L has already been irradiated, when the laser beam L is to be irradiated to each irradiation position.

FIGS. 4A, 4B, 4C, 4D, and 4E are conceptual views showing a portion (hereinafter referred to as a new irradiation portion Rn) in the irradiation range R excluding a region on which the laser beam L has been irradiated. In these examples, a ratio of the irradiation pitch Pt to the irradiation diameter D is 0.5, and the laser beam L is scanned to the right from the upper left end in the target region S1 as the starting point to perform a reciprocating scanning.

Figure 4A:
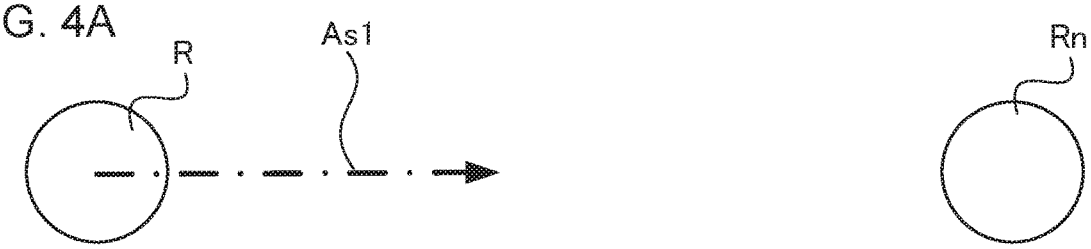
FIGS. 4A, 4B, 4C, 4D, and 4E are conceptual views showing a portion in the irradiation range excluding a region on which the laser beam L has been irradiated.

FIG. 4A is a view showing a new irradiation portion Rn in a case where the upper left end in the target region S1 is irradiated with the laser beam L, i.e., when a first irradiation position is irradiated with the laser beam L. Since no region has been irradiated with the laser beam L, the new irradiation portion Rn is the entire irradiation range R.

Figure 4B:
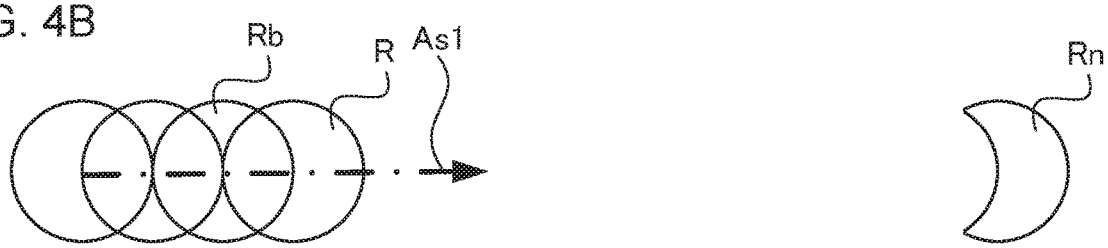

FIG. 4B is a view showing a new irradiation portion Rn in a case where the laser beam L scans the upper end in the target region S1 to the right. In this case, a part on the left side in the irradiation range R overlaps an irradiation range Rb irradiated immediately before. Thus, the new irradiation portion Rn has a shape in which a part on the left side in the circle is cut out.

Figure 4C:
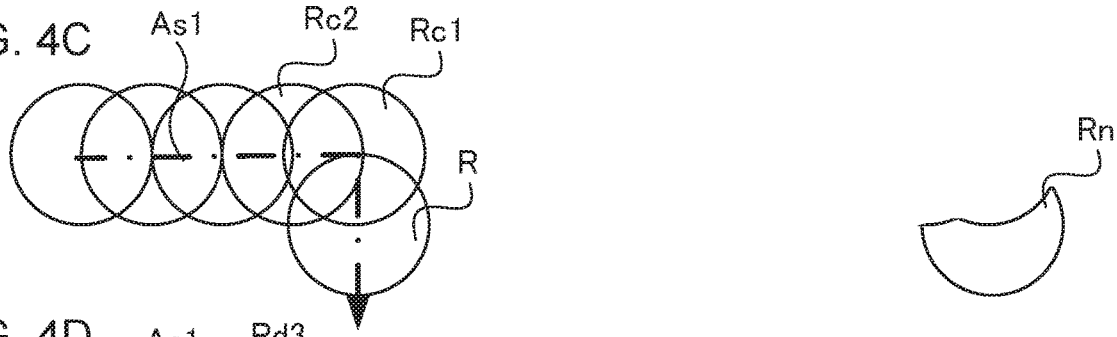

FIG. 4C is a view showing a new irradiation portion Rn in a case where the laser beam scans the left end in the target region S1 downward. In this case, the irradiation range R overlaps two previous irradiation ranges Rc1 and Rc2. Thus, the new irradiation portion Rn has a shape in which an upper part in the circle is cut out.

Figure 4D:
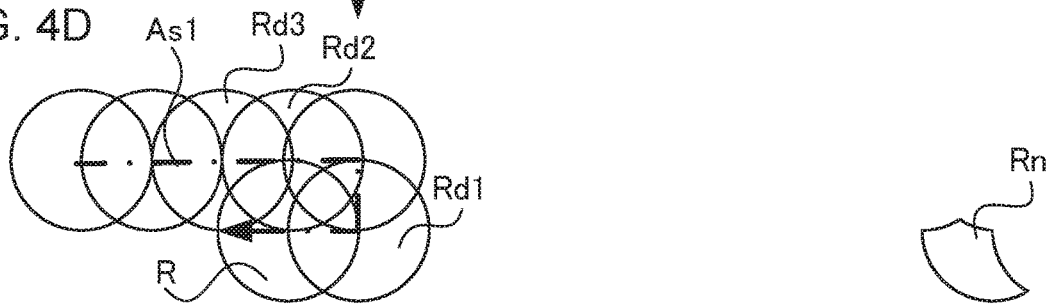

FIG. 4D is a view showing a new irradiation portion Rn in a case where the laser beam L scans a second row from the upper end in the target region S1 to the left. In this case, the irradiation range R overlaps at least three irradiation ranges Rd1, Rd2, and Rd3. Thus, the new irradiation portion Rn has a shape in which a part on the upper side and the right side in the circle is cut out to a considerable extent.

Figure 4E:
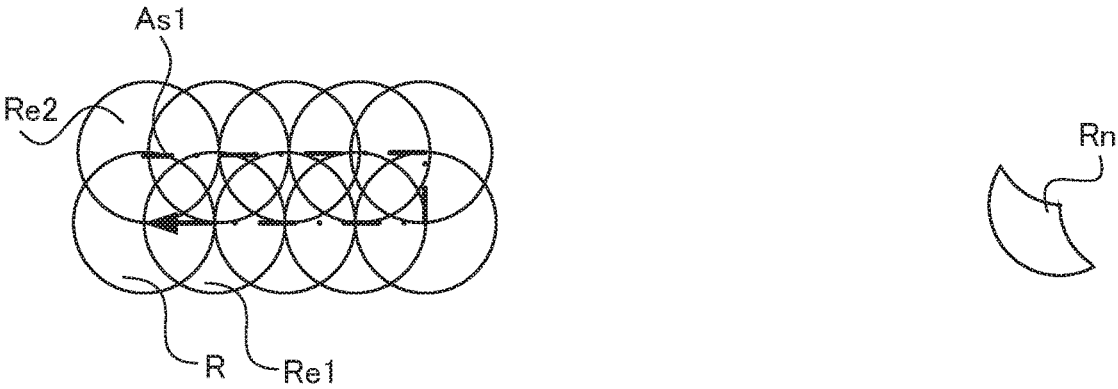

FIG. 4E is a view showing a new irradiation portion Rn in a case where the last irradiation position in the second row from the upper end in the target region S1 is irradiated with the laser beam L. In this case, the irradiation range R overlaps at least two irradiation ranges Re1 and Re2. Thus, the new irradiation portion Rn has a shape in which a part on the upper side and the right side in the circle is cut out.

Among the new irradiation portions Rn in FIGS. 4A to 4E, a portion having the smallest area is the new irradiation portion Rn in FIG. 4D. The data exclusion unit 533 excludes a set of intensity image data corresponding to the uppermost row, the leftmost column, and the rightmost column of the intensity image Mi1, including the areas corresponding to FIGS. 4A, 4B, 4C, and 4E, to create an intensity image Mi again. In other words, the data exclusion unit 533 performs a process of cutting out a part of the intensity image.

If computation based on the considerations as described above is performed to derive a portion to be excluded each time the ionization unit 20 performs ionization, the calculation amount increases. The data exclusion unit 533 therefore preferably refers to the reference data stored in advance in the storage unit 43 to determine a portion to be excluded from the intensity image data.

FIG. 5 is a table Tb showing an example of reference data. In the reference data, the number of rows or columns to be deleted from the upper end, lower end, left end, and right end in the intensity image Mi1 is associated with a ratio of the irradiation pitch Pt to the irradiation diameter D of the laser beam L (hereinafter referred to as an irradiation ratio) and an order of scanning. In table Tb, a reciprocating scanning is assumed. The table Tb show only some of the conditions. For example, the scanning starting point of the laser beam L may include the upper right or lower right and the scanning direction may include the left direction.

Note that the ratio of the irradiation diameter D to the irradiation pitch Pt may be used as the irradiation ratio.

As in the conditions shown in table Tb, at least one of the numbers of rows or columns to be deleted from the upper end, lower end, left end, and right end of the intensity image is preferably different among the conditions, but not particularly limited thereto.

As in the conditions shown in table Tb, when a reciprocating scanning of the laser beam L is sequentially performed at the irradiation positions C corresponding to respective rows in the intensity image, the data exclusion unit 533 excludes data corresponding to a first row from one of the upper and lower ends of the intensity image and one or more columns from both the left and right ends of the intensity image. Additionally, when a reciprocating scanning of the laser beam L is sequentially performed at the irradiation positions C corresponding to respective rows in the intensity image, the data exclusion unit 533 excludes data corresponding to a first column from one of the left and right ends of the intensity image and one or more rows from both the upper and lower ends of the intensity image. As a result, it is possible to obtain an intensity image in which a decrease in accuracy due to the nonuniformity of the amount of the sample S to be ionized is reduced while leaving as many pixels as possible in the intensity image.

Note that the intensity image data of desired ranges may be deleted as long as the exclusion portion specified in reference data is included. Also in this case, it is possible to obtain an intensity image in which a decrease in accuracy due to the nonuniformity of the amount of the sample S to be ionized is suppressed.

The data exclusion unit 533 acquires the irradiation diameter D, the irradiation pitch Pt, the scanning starting point, and the scanning direction from the starting point, which are determined based on the input from the input unit 41 or the like. The data exclusion unit 533 calculates an irradiation ratio from the irradiation diameter D and the irradiation pitch Pt. The data exclusion unit 533 refers to the irradiation ratio and the scanning starting position and direction in the reference data, and acquires the corresponding number of rows and/or columns to be deleted. Based on the information from the reference data acquired in this manner, the data exclusion unit 533 deletes a part of the intensity image data so as to cut out a predetermined number of rows and/or columns from the upper end, the lower end, the left end, and the right end of the intensity image. The intensity image obtained in the above explained manner includes no pixel corresponding to the irradiation position for the deleted intensity image data.

The excluded portion of the intensity image data specified in the reference data is calculated based on an area in the irradiation range R excluding a portion that has already been irradiated with the laser beam L, depending on the irradiation diameter D, the irradiation pitch Pt and the scanning order as in the considerations corresponding to FIGS. 4A to 4E described above.

When irradiation ranges corresponding to irradiation positions do not overlap each other, the data exclusion unit 533 can omit a process of cutting out a part of the intensity image. In this way, the data exclusion unit 533 can change a method of generating and processing the intensity image depending on presence or absence of overlap of the irradiation ranges.

The display control unit 54 creates an intensity image, a sample image, and a display image including information on measurement conditions of the measurement unit 100 or analysis results of the analysis unit 53 such as a mass spectrum and the like, and causes the display unit 44 to display the images.

The analysis unit 53 can perform various analyses in addition to creation of the intensity image using data from which a part thereof is excluded based on the reference data. Such data is not particularly limited as long as the data is measurement data or data based on the measurement data.

Figure 6:
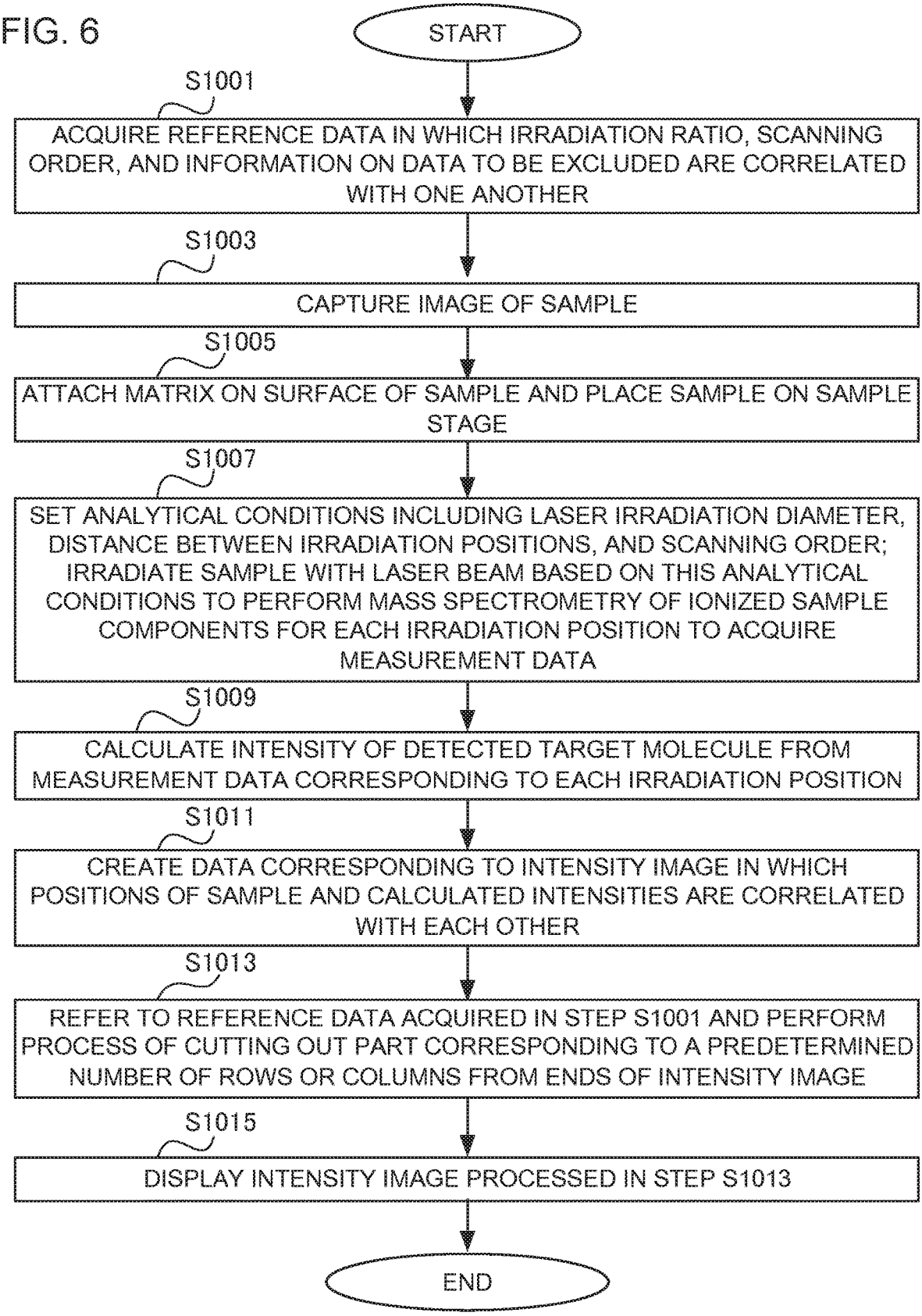
FIG. 6 is a flowchart showing a flow of an analysis method according to one embodiment.

FIG. 6 is a flowchart showing a flow of an analysis method according to the present embodiment. In step S1001, the data exclusion unit 533 acquires data (reference data) correlating a ratio of the irradiation pitch Pt to the irradiation diameter D of the laser beam L (irradiation ratio), an order of scanning a plurality of irradiation positions C (scanning order), and information on the data to be excluded, which is calculated based on an area in the irradiation range R that is irradiated when irradiating the irradiation position C with the laser beam L but excludes a portion that has been already irradiated with the laser beam L. When step S1001 ends, step S1003 is started.

In step S1003, the image-capturing unit 11 captures an image (sample image) of the sample S. At this time, a visualization marker is preferably attached to the surface of the sample S for alignment. When step S1003 ends, step S1005 is started. In step S1005, the user or the like attaches a matrix to the surface of the sample, and the sample S is placed on the sample stage 24. When alignment is performed, an image of the sample S to which the matrix is attached is again captured at the image-capturing position Pa so that the visualization marker is captured in the image. The sample S is then moved to the ionization position Pb by the sample stage drive unit 25, with the sample S fixed to the sample stage 24. This movement is performed so that the sample S is placed at a position where the laser beam L can be irradiated to an irradiation position designated in the sample image by the user by using the visualization marker to correlate the sample image with the image of the sample S to which the matrix is attached. When step S1005 ends, step S1007 is started.

In step S1007, the user or the like sets analytical conditions including the irradiation diameter D of the laser beam L, the irradiation pitch Pt, and the order (scanning order) of scanning the plurality of irradiation positions C. The measurement unit 100 irradiates the sample S with the laser beam L based on the analytical conditions and performs mass spectrometry of the ionized sample components at each irradiation position C to acquire measurement data. When step S1007 ends, step S1009 is started.

In step S1009, the intensity calculation unit 531 calculates an intensity of the detected target molecule, from the measurement data corresponding to each irradiation position C. When step S1009 ends, step S1011 is started. In step S1011, the image creation unit 532 creates data corresponding to an intensity image in which each position of the sample S is correlated with the calculated intensity. When step S1011 ends, step S1013 is started.

In step S1013, the data exclusion unit 533 refers to the reference data acquired in step S1001 and performs a process of cutting out a portion corresponding to a predetermined number of rows and/or columns from the ends of the intensity image. When step S1013 ends, step S1015 is started. In step S1015, the display unit 44 displays the intensity image processed in step S1013. When step S1015 ends, the process is ended.

According to the above-described embodiment, the following advantageous effects can be achieved.

(1) In an analyzing device (information processing unit 40) and an analyzing method according to the present embodiment, the measurement data acquisition unit 51 acquires measurement data obtained by irradiating a plurality of irradiation positions C on a sample S with a laser beam L and performing mass spectrometry of sample components corresponding to each irradiation position C; and the analysis unit 53 performs analysis of the measurement data by excluding data corresponding to a predetermined irradiation position among a plurality of irradiation positions C each having a different new irradiation portion Rn from which a portion that has been already irradiated with the laser beam L is excluded in an irradiation range R irradiated when the laser beam L is irradiated to each of the irradiation positions C. This can reduce a decrease in accuracy in the analysis due to the overlap of irradiation ranges R corresponding to the respective irradiation positions C. In this case, shaping the cross-sectional shape of light flux of the laser beam is not always necessary, which avoids the configuration of the device and the like to be complicated.

(2) In the analyzing device according to the present embodiment, the predetermined irradiation position is determined based on an area of the new irradiation portion R. This can reduce variations in the intensity depending on the irradiation positions C due to the nonuniformity of the amount of the sample S to be ionized.

(3) In the analyzing device according to the present embodiment, the area of the new irradiation portion Rn is calculated based on an irradiation diameter of the laser beam L and a distance between the plurality of irradiation positions C. This can reliably reduce variations in the intensity depending on the irradiation positions C, based on quantitative calculation.

(4) In the analyzing device according to the present embodiment, the analysis unit 53 creates an intensity image data in which intensities of a target molecule corresponding to a predetermined m/z are correlated with a plurality of pixels corresponding to a plurality of respective positions of the sample S; and the plurality of pixels include no pixel corresponding to the predetermined irradiation position. This can reduce variations in the intensity in the intensity image due to overlap of the irradiation ranges R corresponding to the respective irradiation positions C.

(5) In the analyzing device according to the present embodiment, when rows and columns are respectively assigned to pixels arranged in the horizontal direction and pixels arranged in the vertical direction of the intensity image, the analysis unit 53 can exclude a set of data corresponding to a predetermined number of rows and/or columns from ends of the intensity image, in data such as measurement data or intensity image data based on the measurement data. As a result, variations in intensity in various data such as measurement data and intensity image data can be efficiently reduced.

(6) In the analyzing device according to the present embodiment, the analysis unit 53 excludes sets of data corresponding to first and second numbers of rows from upper and lower ends of the intensity image, respectively, in data such as the measurement data or data based on the measurement data, and excludes sets of data corresponding to third and fourth numbers of columns from left and right ends, respectively, wherein at least one of the first, second, third, and fourth numbers may be different from the other numbers. As a result, variations in the intensity in various data such as measurement data and intensity image data can be efficiently reduced.

(7) The analyzing device according to the present embodiment further includes the display unit 44 that displays the intensity image. As a result, a distribution of the target molecule in the sample S can be clearly shown to the user or the like who views the display unit 44.

(8) The analytical device 1 according to the present embodiment includes the above-described analyzing device (information processing unit 40) and a mass spectrometer (mass spectrometry unit 30) that performs the mass spectrometry. This can reduce a decrease in accuracy in the analysis, even when the sample S is irradiated with the laser beam L so that irradiation ranges R corresponding to the respective irradiation positions C overlap each other.

The following modifications are also included within the scope of the present invention and any of the modifications can be combined with the embodiment described above. In the following modifications, parts having the same structure and function as those in the above-described embodiment are denoted by the same reference numerals, and the description thereof will be omitted as appropriate.

First Modification

Although the analytical device 1 according to the above-described embodiment is an imaging mass spectrometry device including an ion trap and a time-of-flight mass separation unit, the configuration of the mass spectrometry unit 30 is not particularly limited. The mass spectrometry unit 30 may include a mass separation unit composed of one mass analyzer or a mass separation unit composed of two or more mass analyzers in combination different from the above-described embodiment. For example, the analytical device 1 can be configured as a quadrupole time-of-flight mass spectrometer, a single time-of-flight mass spectrometer, a tandem time-of-flight mass spectrometer, a single quadrupole mass spectrometer, or a triple quadrupole mass spectrometer. Further, the time-of-flight mass separation unit of the mass spectrometry unit 30 may be of an orthogonal acceleration type, other than a type of accelerating in a direction along a direction of entering into the time-of-flight mass analyzer as shown in FIG. 1. Moreover, the time-of-flight mass separation unit may be of a linear type or multi-turn type, other than the reflectron type shown in FIG. 1.

In a case where the analytical device 1 constitutes a tandem mass spectrometer or a multi-stage mass spectrometer, the way of dissociation is not particularly limited. For example, collision induced dissociation (ID), post-source decomposition, infrared multiphoton dissociation, photoinduced dissociation, and dissociation using radicals may be used as appropriate.

Second Modification

In the above-described embodiment, the irradiation position corresponding to a set of data to be deleted by the data exclusion unit 533 is calculated based on conditions of the irradiation diameter D, the irradiation pitch Pt, and the irradiation order. However, positions of a standard sample having a predetermined concentration may be irradiated with a laser beam under these conditions to perform mass spectrometry in advance, and an irradiation position corresponding to a set of data to be excluded may be determined based on the detected intensity. For example, the control unit 50 may determine an irradiation position corresponding to a set of data to be excluded so that variations in the intensity at irradiation positions of the standard sample after exclusion of the data, that is, after exclusion of one or more irradiation positions is equal to or less than a predetermined value. The predetermined value is appropriately set such that, for example, a ratio of the standard deviation to the arithmetic mean of intensities of the standard sample corresponding to the respective irradiation positions is 10% or less.

Third Modification

In the above-described embodiment, an irradiation range of the laser beam L corresponding to each irradiation position of the sample S is a circle; however it may be any shape such as an ellipse. Even in such a case, irradiation positions corresponding to a set of data to be excluded can be calculated based on overlap of the irradiation ranges corresponding to the respective irradiation positions, and a set of data is excluded to perform an analysis so that the same effect as in the above-described embodiment can be achieved. If it is difficult to calculate irradiation positions corresponding to a set of data to be excluded, the irradiation positions may be determined based on the result of performing mass spectrometry on a standard sample or the like under the same conditions in advance as in the above-described modification.

Fourth Modification

Although the way of scanning by the laser beam L is the reciprocating scanning in the above-described embodiment, the device control unit 52 may control the laser beam L to scan always in the same direction.

Figure 7:
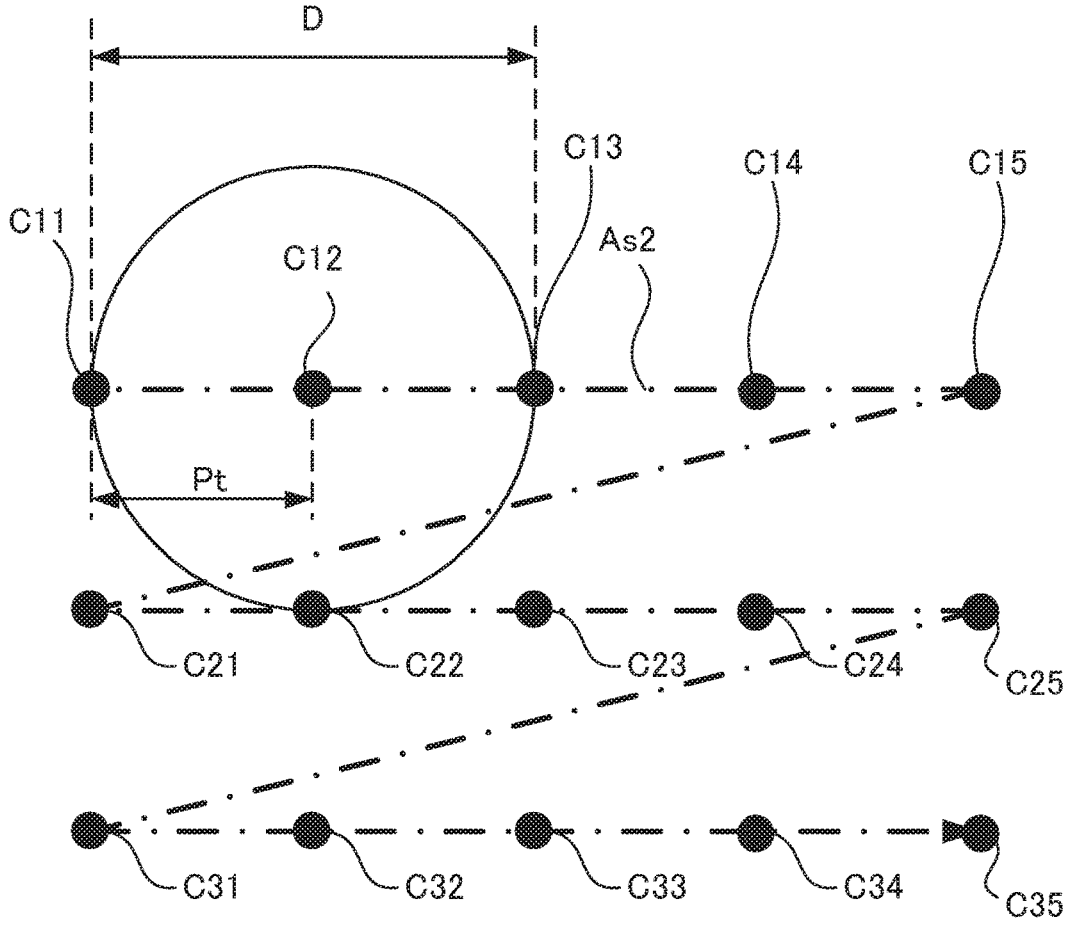
FIG. 7 is a conceptual view for explaining scanning by a laser beam.

FIG. 7 is a conceptual view showing an order of scanning by the laser beam L in the present modification. Irradiation positions C are located on lattice points of a square lattice as in FIG. 2B. The laser beam L scans irradiation positions C12, C13, C14, and C15 in this order to the right from an irradiation position C11 at the upper left end as a starting point. Thereafter, an irradiation position C21 at the left end of the next row is irradiated, and scanning is then again performed on irradiation positions C22, C23, C24, and C25 in this order to the right. Thereafter, an irradiation position C31 at the left end of the next row is further irradiated, and scanning is then again performed on irradiation positions C32, C33, C34, and C35 in this order to the right. In this way, in the present modification, the device control unit 52 scans the laser beam L always in the same direction, row by row or column by column.

Also in this case, as in the above-described embodiment, irradiation positions corresponding to a set of data to be excluded can be determined based on the irradiation diameter D and the irradiation pitch Pt having various values. For example, in FIG. 7, it is assumed that the irradiation diameter D is twice as long as the irradiation pitch Pt. When a set of data corresponding to one row from the upper end and one column from the left end of the intensity image in the intensity image data is deleted, the remaining data becomes data in which variations in the amount of the sample S to be ionized is reduced.

Note that scanning may be performed in a way other than the scanning described in the present modification and the reciprocating scanning.

Fifth Modification

In the above-described embodiment, after the image creation unit 532 creates the intensity image data, the data exclusion unit 533 deletes a part of the intensity image data. However, the image creation unit 532 may create the intensity image data without using some data determined based on the reference data, in the measurement data. Based on the irradiation ratio and the scanning order, the image creation unit 532 refers to the corresponding "number of rows and/or columns to be deleted" in the reference data, and creates intensity image data without using some data corresponding to the rows and/or columns to be deleted in the measurement data.

In a conventional method, the presence of the high-intensity pixels Pa (FIG. 3B) unnecessarily increases a value of the maximum intensity in the intensity image data. Additionally, a wide range of intensity values is converted into a predetermined range of pixel values. Therefore, the contrast of the intensity image Mi1 is lowered for the pixels Px other than the high-intensity pixels Pa, so that detail is lost (see the intensity image Mi1 in FIG. 3B). According to the analyzing method according to the present modification, such a problem can be solved because the intensity is converted into the pixel value after excluding some data corresponding to the high-intensity pixel Pa in the measurement data.

Figure 8:
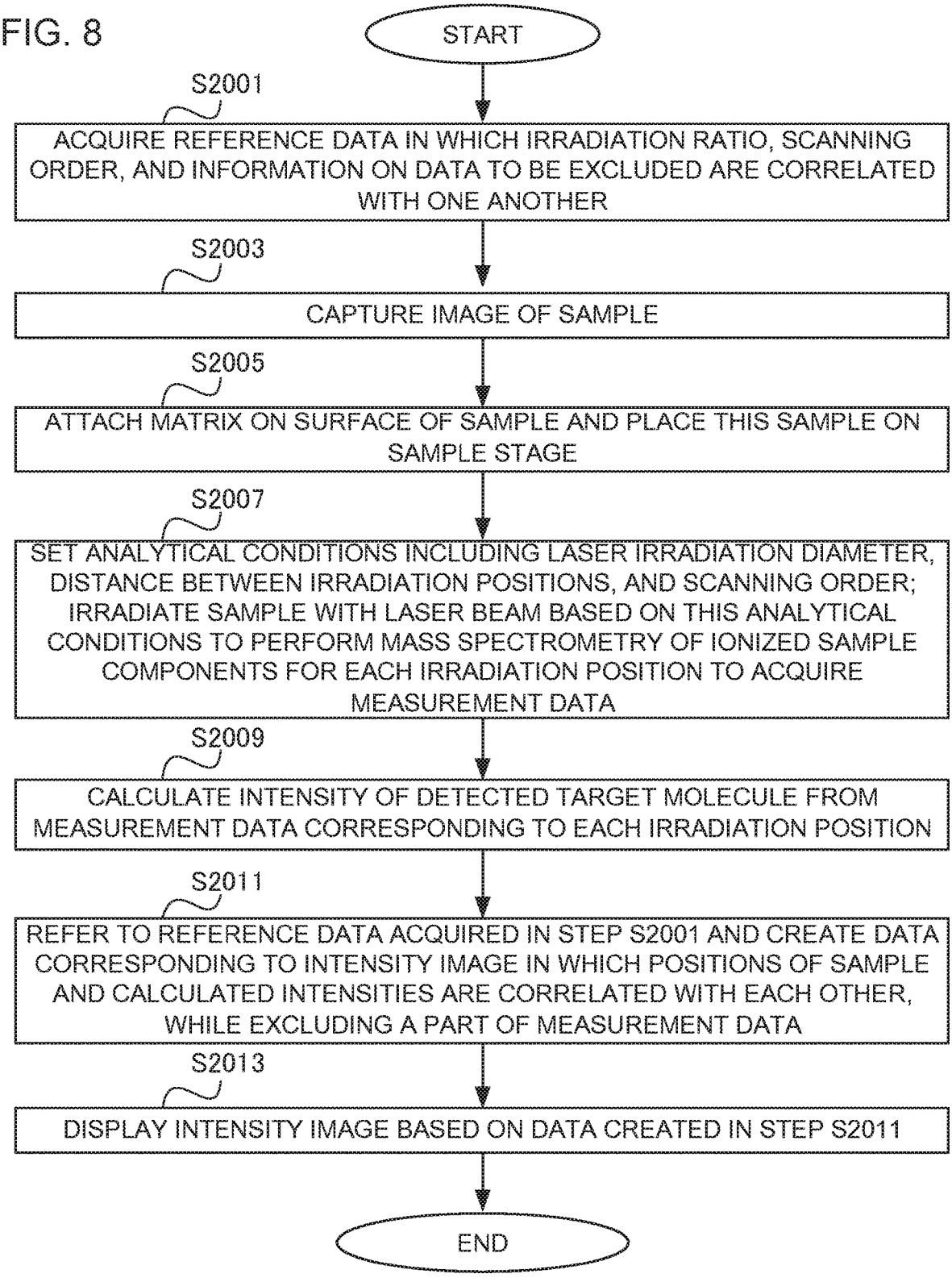
FIG. 8 is a flowchart showing a flow of an analysis method according to a modification.

FIG. 8 is a flowchart showing a flow of the analysis method according to the present modification. Steps S2001 to S2009 are the same as steps S1001 to S1009 in the flowchart of the above-described embodiment, and thus the description thereof is omitted. When step S2009 ends, step S2011 is started.

In step S2011, the image creation unit 532 refers to the reference data acquired in step S2001 and creates data corresponding to an intensity image in which each position of the sample S is correlated with the calculated intensity, while excluding a part of the measurement data. When step S2011 ends, step S2013 is started. In step S2013, the display unit 44 displays an intensity image based on the data created in step S2011. When step S2013 ends, the process is ended.

Sixth Modification

Programs for achieving the information processing functions of the analytical device 1 may be recorded in a computer readable recording medium. The programs, which are recorded in the recording medium, for control of measurement, analysis, and display processing and their related processing, including the processing by the above-described image creation unit 532 and data exclusion unit 533 may be read and executed by a computer system. Note that the term "computer system" includes an operating system (OS) and hardware of peripheral devices. The term "computer-readable recording medium" refers to a portable recording medium such as a flexible disk, a magneto-optical disk, an optical disk, and a memory card, and a storage device such as a hard disk incorporated in a computer system. Furthermore, the term "computer-readable recording medium" may include medium that dynamically holds a program for a short time, such as a communication line in a case where a program is transmitted via a network such as the Internet or a telecommunication line such as a telephone line, or a medium that holds a program for a certain period of time, such as a volatile memory in a computer system that is a server or a client in that case. Further, the above-described program may achieve a part of the above-described functions, or may be combined with a program already recorded in a computer system to achieve the above-described functions.

Figure 9:
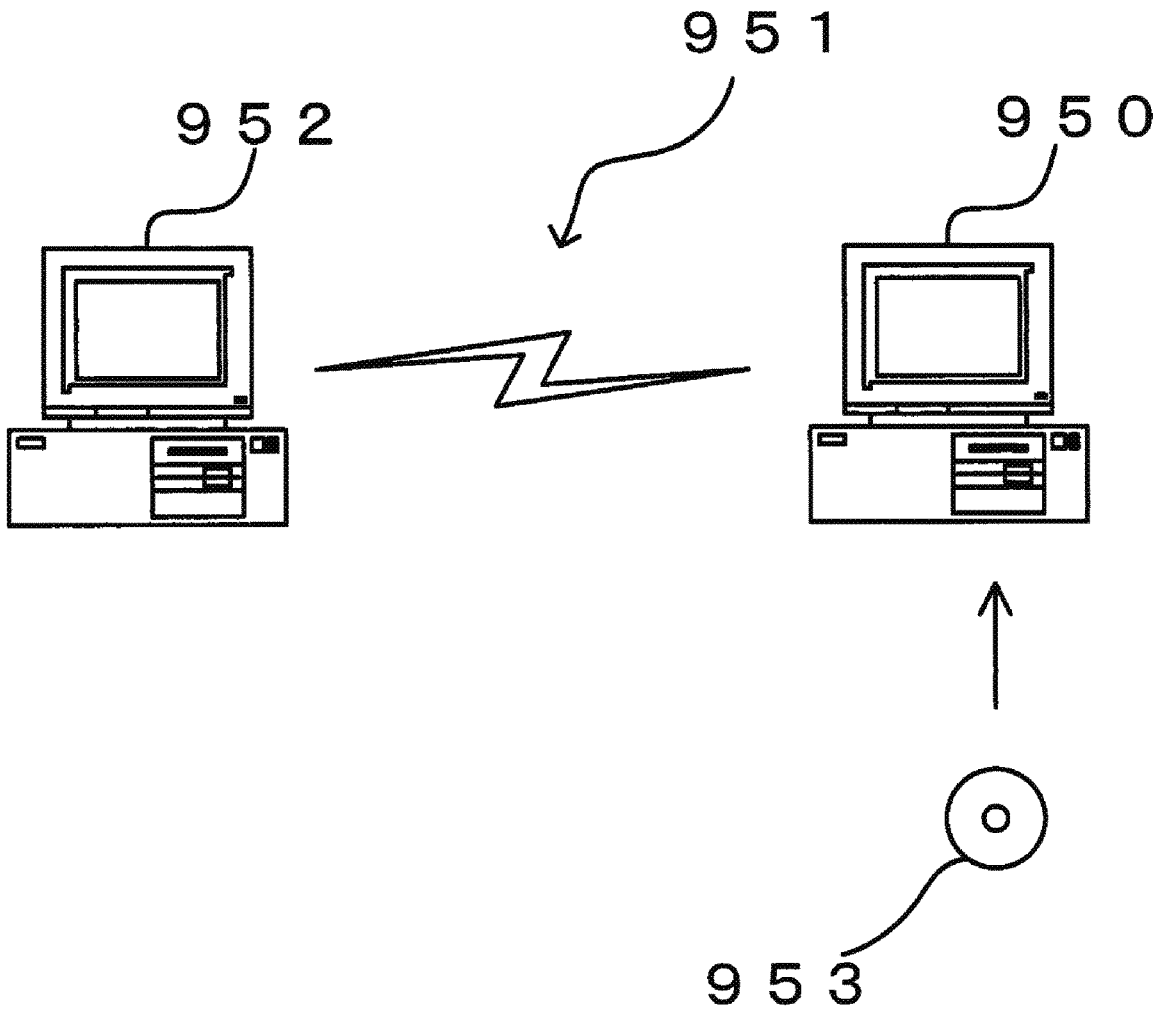
FIG. 9 is a conceptual view for explaining how program is provided.

When applied to a personal computer (hereinafter referred to as a PC) or the like, the program relating to the control described above can be provided through a recording medium such as a CD-ROM or a data signal such as the Internet. FIG. 9 shows such a situation. A PC 950 receives a program via a CD-ROM 953. The PC 950 also has a connection function with a communication line 951. A computer 952 is a server computer that provides the above-described program, and stores the program in a recording medium such as a hard disk. The communication line 951 may be the Internet, a communication line such as personal computer communication, a dedicated communication line, or the like. The computer 952 reads the program using a hard disk, and transmits the program to the PC 950 via the communication line 951. That is, the program is carried by a carrier wave as a data signal and transmitted through the communication line 951. Thus, the program can be supplied as various forms of computer readable computer program products such as a recording medium and a carrier wave.

Programs for achieving the above-described information processing functions include a program that causes a processor to perform: a measurement data acquisition process (which corresponds to step S1007 in FIG. 6 and step S2007 in FIG. 8) of acquiring measurement data obtained by irradiating a plurality of irradiation positions C on a sample S with a laser beam L and performing mass spectrometry on a sample component corresponding to each irradiation position C; and an analysis process (which corresponds to step S1013 in FIG. 6 and step S2011 in FIG. 8) of performing analysis of the measurement data by excluding data corresponding to a predetermined irradiation position among a plurality of irradiation positions at which a new irradiation portion Rn excluding a portion that has been already irradiated with the laser beam in an irradiation range R irradiated when the laser beam L is irradiated to each of the irradiation positions C are different from each other. This can reduce a decrease in accuracy in the analysis due to the overlap of irradiation ranges R corresponding to the respective irradiation positions C.

The present invention is not limited to the above-described embodiments. Other embodiments contemplated within the scope of the technical concept of the present invention are also included within the scope of the present invention.

REFERENCE SIGNS LIST

1 . . . analytical device, 10 . . . sample image capturing unit, 11 . . . image-capturing unit, 20 . . . ionization unit, 21 . . . laser irradiation unit, 22 . . . condensing optical system, 24 . . . sample stage, 25 . . . sample stage drive unit, 30 . . . mass spectrometry unit, 32 . . . first mass separation unit, 33 . . . second mass separation unit, 40 . . . information processing unit, 43 . . . storage unit, 50 . . . control unit, 51 . . . measurement data acquisition unit, 52 . . . device control unit, 53 . . . analysis unit, 54 . . . display control unit, 100 . . . measurement unit, 300 . . . vacuum chamber, 330 . . . detection unit, 531 . . . intensity calculation unit, 532 . . . image creation unit, 533 . . . data exclusion unit, C, C11, C12, C13, C14, C15, C21, C22, C23, C24, C25, C31, C32, C33, C34, C35 . . . irradiation position, Mi0, Mi1 . . . intensity image, Rn . . . new irradiation portion, S . . . sample, S1 . . . target region, Si . . . sample-derived ion, Pt . . . irradiation pitch, R, R11, R12 . . . irradiation range, Ro . . . overlap portion of irradiation ranges

The invention claimed is:

1. An analyzing device, comprising:

a processor; and a program that that causes the processor to perform:

a measurement data acquisition process of acquiring measurement data obtained by irradiating a plurality of irradiation positions on a sample with a laser beam and performing mass spectrometry on a sample component corresponding to each irradiation position; and an analysis process of performing analysis of the measurement data by excluding a set of data corresponding to an excluded irradiation position among the plurality of irradiation positions each having a different irradiation portion from which a portion that has been already irradiated with the laser beam is excluded in an irradiation range irradiated when the laser beam is irradiated to each irradiation position.

2. The analyzing device according to claim 1, wherein:

the excluded irradiation position is determined based on a value of an area of the irradiation portion.

3. The analyzing device according to claim 2, wherein:

the area is calculated based on an irradiation diameter of the laser beam and a distance between the plurality of irradiation positions.

4. The analyzing device according to claim 3, wherein:

the processor creates data corresponding to an intensity image in which intensities of a molecule corresponding to a predetermined m/z are correlated with a plurality of pixels corresponding to a plurality of respective positions of the sample; and the plurality of pixels include no pixel corresponding to the excluded irradiation position.

5. The analyzing device according to claim 2, wherein:

the processor creates data corresponding to an intensity image in which intensities of a molecule corresponding to a predetermined m/z are correlated with a plurality of pixels corresponding to a plurality of respective positions of the sample; and the plurality of pixels include no pixel corresponding to the excluded irradiation position.

6. The analyzing device according to claim 1, wherein:

the processor creates data corresponding to an intensity image in which intensities of a molecule corresponding to a predetermined m/z are correlated with a plurality of pixels corresponding to a plurality of respective positions of the sample; and the plurality of pixels include no pixel corresponding to the excluded irradiation position.

7. The analyzing device according to claim 6, wherein:

the processor excludes a set of data corresponding to a predetermined number of rows or columns from an end of the intensity image in the measurement data or in data based on the measurement data, when creating data corresponding to the intensity image.

8. The analyzing device according to claim 7, wherein:

the processor excludes a set of data corresponding to first and second numbers of rows from upper and lower ends of the intensity image, respectively, in the measurement data or the data based on the measurement data, and excludes a set of data corresponding to third and fourth numbers of columns from left and right ends of the intensity image, respectively, wherein at least one of the first, second, third, and fourth numbers is different from other numbers.

9. The analyzing device according to claim 8, wherein:

when the plurality of irradiation positions corresponding to respective rows in the intensity image are sequentially scanned by the laser beam, the processor excludes a first row from one of the upper and lower ends of the intensity image and at least one column from the left and right ends of the intensity image; and when the plurality of irradiation positions corresponding to respective columns in the intensity image are sequentially scanned by the laser beam, the processor excludes a first column from one of the left and right ends of the intensity image and at least one row from the upper and lower ends of the intensity image.

10. The analyzing device according to claim 7, comprising:

a display unit that displays the intensity image.

11. The analyzing device according to claim 8, comprising:

a display unit that displays the intensity image.

12. The analyzing device according to claim 9, comprising:

a display unit that displays the intensity image.

13. The analyzing device according to claim 6, comprising:

a display unit that displays the intensity image.

14. An analytical device, comprising:

the analyzing device according to claim 1; and a mass spectrometer that performs mass spectrometry.

15. An analyzing method, comprising:

acquiring measurement data obtained by irradiating a plurality of irradiation positions on a sample with a laser beam and performing mass spectrometry on a sample component corresponding to each irradiation position; and analyzing the measurement data by excluding a set of data corresponding to an excluded irradiation position among the plurality of irradiation positions each having a different irradiation portion from which a portion that has been already irradiated with the laser beam is excluded in an irradiation range irradiated when the laser beam is irradiated to each irradiation position.

16. A computer readable computer program product having a program that causes a processor to perform:

a measurement data acquisition process of acquiring measurement data obtained by irradiating a plurality of irradiation positions on a sample with a laser beam and performing mass spectrometry on a sample component corresponding to each irradiation position; and an analysis process of performing analysis of the measurement data by excluding a set of data corresponding to an excluded irradiation position among the plurality of irradiation positions each having a different irradiation portion from which a portion that has been already irradiated with the laser beam is excluded in an irradiation range irradiated when the laser beam is irradiated to each irradiation position.

* * * * *